United States Patent [19]

McGowan

[11] 3,967,218

[45] June 29, 1976

[54] EDGE-GUIDED WAVE DIRECTIONAL COMBINER

[75] Inventor: Joseph W. McGowan, Spring Lake Heights, N.J.

[73] Assignee: The United States of America as represented by the Secretary of the Army, Washington, D.C.

[22] Filed: Sept. 26, 1975

[21] Appl. No.: 617,210

[52] U.S. Cl. ..... 333/1.1; 333/24.2; 330/53; 330/124 R; 330/147

[51] Int. Cl.[2] ..... H01P 1/34

[58] Field of Search ..... 333/1.1, 24.1, 24.2, 333/95 S

[56] References Cited

UNITED STATES PATENTS 3,845,413 10/1974 Chiron et al. ..... 333/1.1

*Primary Examiner*—Paul L. Gensler

*Attorney, Agent, or Firm*—Nathan Edelberg; Sheldon Kanars; Frank Dynda

[57] ABSTRACT

An edge-guided mode microstrip device having a pair of input ports and a common output port, with two separate ferrite substrates each having a microstrip conductor electrically connected between a respective input port and the common output port. Both microstrip conductors additionally each have a conductive or inner edge spanned by a resistive film which acts as a resistive load. The other or outside conductive edge of each of the conductors includes an exponentially tapered segment which when a predetermined biasing magnetic field is applied transversely relative to the field of the substrates, causes input microwave energy at the two input ports to travel along the respective exponentially tapered edges and combine at the common output port. Any reflective energy returning from the output port will travel along the inner edges and be absorbed in the resistive load.

11 Claims, 6 Drawing Figures

EDGE-GUIDED WAVE DIRECTIONAL COMBINER

The invention described herein may be manufactured and used by or for the Government for governmental purposes without the payment of any royalties thereon or therefor.

BACKGROUND OF THE INVENTION

This invention relates generally to microwave apparatus and more particularly to a microstrip device which is adapted to operate as a power combiner over a relatively wide bandwidth.

DESCRIPTION OF THE PRIOR ART

Microstrip devices operable in an edge-guided mode wherein energy propagates along the edges of a metal conductor layer have been described, for example, in U.S. Pat. Nos. 3,617,951 and 3,555,459 issued to R. Anderson and in a publication entitled "Reciprocal and Non-Reciprocal Modes of Propagation in Ferrite Stripline and Microstrip Devices", *IEEE Transaction on Microwave Theory and Techniques*, Volume MTT-19, No. 5, May 1971, pp. 442–451, M.E. Hines.

In the devices taught therein, the dominant mode resembles TEM energy propagation except that there is a strong transverse field displacement causing the wave energy to be concentrated along the edges of a metal stripline conductor formed on the surface of a ferrite substrate located on a metal ground plane and having a magnetic field applied thereto perpendicular to the ground plane. The edges are designed to be free of abrupt changes in order that there be no abrupt impedance change of the circuit. Non-reciprocal behavior is obtained by asymmetrically loading the edges.

Additionally conventional microwave circulators, devices well known to those skilled in the art, typically have the property that power incident at one port travels to an adjacent port while power incident at said adjacent port travels to the following adjacent port, depending upon the direction of the ferrite biasing field. In any event, energy travels either in a clockwise sense or counter-clockwise sense, always exiting at the port adjacent to the input port in either a clockwise or counter-clockwise rotation.

SUMMARY

The present invention is directed to an improvement in edge-guided mode stripline devices and briefly comprises a multiport (at least three) device having a ground plane upon which at least two ferrite substrates are located and upon which a respective stripline conductor is formed. One end of both stripline conductors terminates in a common port (output), while their opposite ends are electrically connected to separate other ports (input), said separate other ports being located adjacent one another. Both stripline conductors include conductive edges, one of which includes an exponential tapered segment which when a predetermined biasing field is applied perpendicular to the respective substrates, is adapted to propagate energy incident at the adjacent input ports to the common output port. The other edge of the stripline conductors are spanned by a resistive film which acts as a resistive load for any energy tending to travel along the other edge back to the input port which, for example, might be reflected from the common output port.

DESCRIPTION OF THE PREFERRED EMBODIMENT

Figure 1A:
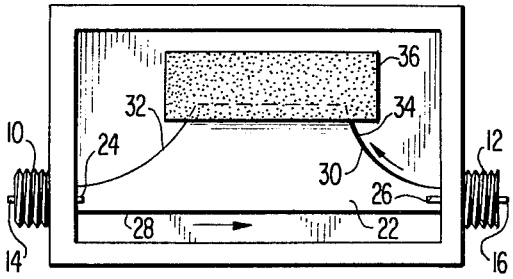
FIG. 1(A) (PRIOR ART)
FIGS. 1A and 1B are, respectively, a top plan view and a longitudinal cross-sectional view typically illustrative of an edge-guided mode microstrip isolator.
Figure 1B:
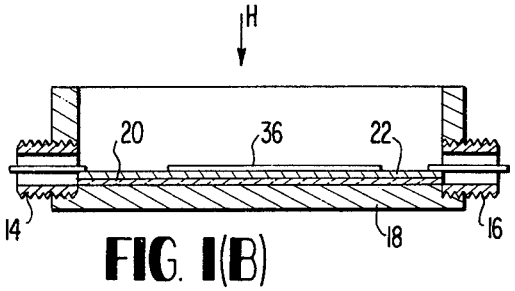
FIG. 1(B) (PRIOR ART)

Referring now to the drawings, and more particularly to FIGS. 1A and 1B, there is shown a typical prior art device known as an "edge-guided mode" isolator. This device is a two port device wherein there is an input port and an output port comprised of the coaxial connectors 10 and 12, respectively. The outer conductors 14 and 16 of the connectors 10 and 12 are mechanically secured to a metallic ground plane 18 (FIG. 1B) over which a ferrite substrate 20 is contiguously located. A stripline metal conductive layer 22 is formed on the ferrite substrate 20 as shown in FIG. 1A so that its end portions are in electrical contact with the inner conductors 24 and 26 of the coaxial connectors 10 and 12.

The conductive layer 22 includes a pair of edges 28 and 30 along which electrical energy is adapted to travel when a biasing magnetic field H of predetermined magnitude is applied transversely or perpendicularly to the ground plane 18. The edge 28 comprises a substantially straight edge between the connectors 10 and 12, while the edge 30 contains two segments 32 and 34 having an exponential taper. Intermediate the tapered segments 32 and 34 is a resistive film 36 applied over the edge 30, which is adapted to act as a resistive load. Thus, for example, power incident at one port i.e. connector 10 can be made to travel along either edge 28 or 30 of the stripline conductor 22 and exit out of the other port, i.e. connector 12 by choosing the proper biasing magnetic field H for the ferrite substrate 20. Accordingly, applying a transverse magnetic field H of a predetermined magnitude perpendicular to the ground plane 18, microwave energy incident at connector 10 can be made to travel along edge 28 to the output connector 12. Any energy incident at output connector 12, such as caused by some type of energy reflection external to the device, will accordingly travel back along the edge 30 and more particularly the tapered segment 34 where it is then absorbed by the resistive load that comprises the film 36.

Figure 2:
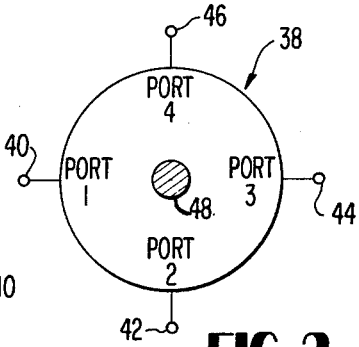
FIG. 2 (PRIOR ART)
FIG. 2 is a diagrammatic view of a prior art microwave power circulator.

Prior to discussing the preferred embodiment of the subject invention, attention is next directed to FIG. 2, where there is schematically disclosed a well known microwave circulator device which is adapted to be connected to signal terminals 40, 42, 44 and 46. Such a device utilizes a ferrite puck 48, which upon the application of a biasing magnetic field therethrough is adapted to control the flow of microwave energy within the device. For example, a biasing magnetic field of a first direction will cause energy applied to terminal 40 to flow from port 1 in a counter-clockwise direction to port 2, while a biasing magnetic field of an opposite direction will cause incident energy at port 1 to be directed in a counter-clockwise direction to port 4 and couple therefrom from terminal 46.

Figure 3A:
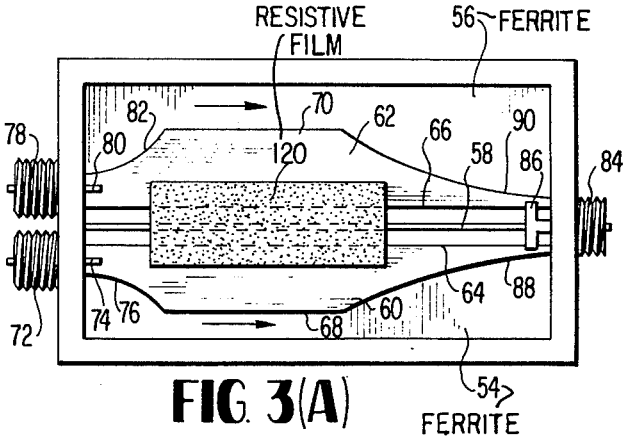
FIGS. 3A and 3B are, respectively, a top plan view and a longitudinal cross-sectional view of the preferred embodiment of the subject invention.
Figure 3B:
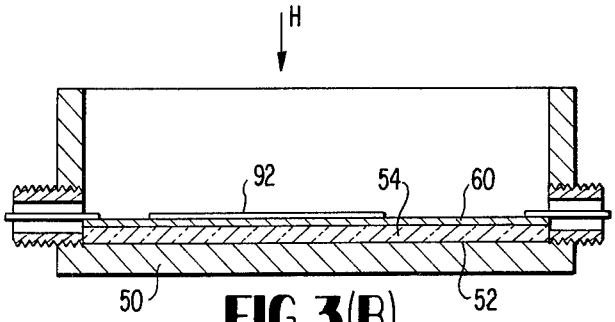

The device contemplated by the subject invention is shown in its preferred form in FIGS. 3A and 3B and as in the case of the prior art isolator device shown in FIGS. 1A and 1B, includes a ground plane 50 which is adapted to have a ferrite substrate contiguously placed on its inner upper surface 52. However, in the present invention, a pair of ferrite substrates 54 and 56, being separated by a gap 58, and being substantially identical in size and shape and are placed in a co-planar position on the ground plane 50, each having a respective metal stripline conductor 60 and 62 formed thereon. Both stripline conductors 60 and 62 are patterned substantially alike and have adjacent inner edges 64 and 66 which are substantially straight while their respective outer edges 68 and 70 include tapered edge segments adjacent a respective pair of signal ports.

More particularly, a coaxial connector 72 which is adapted to act as an input port has its inner conductor 74 in electrical contact with the stripline conductor 60 adjacent the exponentially tapered edge segment 76. In a like manner, a second coaxial connector 78 located next to the coaxial connector 72, is also adapted to be an input port having its inner conductor 80 electrically connected to the stripline conductor 62 adjacent an exponentially tapered segment 82. The opposite extremities of the stripline conductors terminate in a common port comprised of an output connector 84 having an inner conductor 86 connected to both stripline conductors adjacent relatively longer exponentially tapered edge segments 88 and 90.

A common resistive load is provided along a predetermined length of the inner edges 64 and 66 by a layer of resistive film 120 which is substantially rectangular in configuration and which spans both conductors 60 and 62 at a location intermediate the tapered edge segments of the outer edges. The film 120, however, does not touch the outer edges 68 and 70. Upon the application of the biasing magnetic field H of a predetermined magnitude, transversely through the ground plane 50 of a predetermined magnitude, microwave signals coupled to connectors 72 and 78 will travel along the outside edges 68 and 70 including the tapered segments to the common output connector 84. By selectively choosing proper line lengths of the edges the device is made relatively insensitive to changes in frequency and phase, thus making it a relatively broadband device.

It can be shown by reference to the aforementioned Hines publication that the characteristic impedance for a device of the type shown in FIGS. 3A and 3B is directly proportional to the substrate thickness. Accordingly, in order to obtain an impedance match between the output (connector 84) and the inputs (connectors 72 and 78), it merely becomes necessary to adjust the substrate thickness to provide the required impedance match, which may be, for example, 50 ohms.

Figure 4:
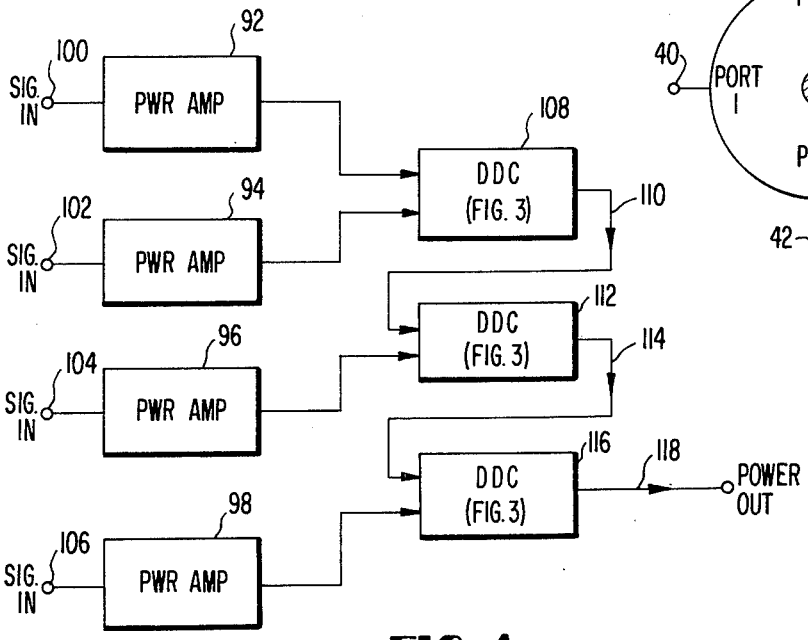
FIG. 4 is a block diagram illustrative of a power combiner system utilizing the device of the subject invention.

The present invention has particular application where power outputs from, for example, intermediate power amplifiers can be combined to provide a relatively high power output while eliminating the need for a high power circulator, such as shown in FIG. 2. Such an arrangement is shown in FIG. 4, wherein four power amplifiers 92, 94, 96 and 98 each having respective input signals applied to terminals 100, 102, 104 and 106 are combined in the following fashion. A first dual directional coupler 108 according to the subject invention receives amplified power inputs from the power amplifiers 92 and 94 and combines these signals into a common output on transmission line 110, which is applied to one input of a second dual directional coupler 112, which additionally receives an input from the third power amplifier 96. The combined power outputs of the three amplifiers 92, 94 and 96 thus combined in the device 112 is fed via the transmission line 114 to the input of a third dual directional coupler 116, which has its other input coupled to the output of the fourth amplifier 98. The third dual directional coupler 116 thus provides a final combining device whose output on transmission line 118 comprises the combined outputs of all four amplifiers 92, 94, 96 and 98.

Thus what has been shown and described is a means for increasing the power handling capability of a system wherein each active element required for power amplification in the system, which may be for example a radar, is limited. A device according to the subject invention is not only capable of combining signals of the same frequency and phase, but is also capable of combining signals of different frequency and phases due to the broadband characteristic achieved.

Having thus shown and described what is at present considered to be the preferred embodiment of the subject invention, I claim:

1. An edge-guided mode microwave transmission device, comprising in combination:

a ground plane;

ferromagnetic substrate means of a predetermined thickness located on said ground plane;

at least two mutually separated stripline conductors of substantially like conductor patterns formed on said substrate means, each pattern having a pair of conductive edges, one edge of which includes at least one tapered edge segment adapted to effect energy transfer therealong for a predetermined biasing magnetic field;

means providing a biasing magnetic field of a predetermined magnitude and which is applied transverse to said ground plane;

resistive load means commonly applied over a predetermined length of the other conductive edge of said at least two conductors;

a first signal port coupled to one end of one of said two conductors;

a second signal port coupled to a like end of the other of said two conductors; and a third signal port commonly coupled to the opposite end of said two conductors.

2. The device as defined by claim 1 wherein said substrate means comprises a pair of substrates having a predetermined separation therebetween.

3. The device as defined by claim 2 wherein said pair of substrates comprises a pair of planar substrates of ferrite.

4. The device as defined by claim 3 wherein said two stripline conductors are disposed mutually parallel and wherein said other conductive edge of said conductors are substantially linear and constitute the inner conductive edge of said device while said one edge constitutes the outer conductive edge.

5. The device as defined by claim 4 wherein said at least one tapered edge segment comprises an exponential taper of predetermined length.

6. The device as defined by claim 5 wherein said one edge includes a second exponentially tapered edge segment, said first and second segments being respectively located adjacent each end of the respective stripline conductor.

7. The device as defined by claim 6 wherein the tapered edge segment adjacent the third signal port is of a greater length than the tapered portion adjacent the signal port coupled to the other end.

8. The device as defined by claim 7 wherein said resistive load means is located intermediate said first and second tapered edge segments.

9. The device as defined by claim 8 wherein said resistive load means comprises a resistive film overlaying both said conductors, said resistive film being adapted to absorb any energy traveling along said other conductive edge from said third signal port.

10. The device as defined by claim 9 wherein said first, second and third signal ports include coaxial connectors.

11. The device as defined by claim 10 wherein said first and second coaxial connectors are located adjacent one another at one end of said device while said third coaxial connector is located at the other end of said device.

* * * * *